US005726894A

United States Patent [19]

Sansone

[11] Patent Number: 5,726,894

[45] Date of Patent: Mar. 10, 1998

[54] POSTAGE METERING SYSTEM INCLUDING MEANS FOR SELECTING POSTAL PROCESSING SERVICES FOR A SHEET AND DIGITALLY PRINTING THEREON POSTAL INFORMATION PERTAINING TO EACH SELECTED POSTAL PROCESSING SERVICE

[75] Inventor: Ronald P. Sansone, Weston, Conn.

[73] Assignee: Pitney Bowes Inc., Stamford, Conn.

[21] Appl. No.: 576,660

[22] Filed: Dec. 21, 1995

[51] Int. Cl.[6] ..... G07B 17/00

[52] U.S. Cl. ..... 364/464.18; 101/71; 364/464.12

[58] Field of Search ..... 101/71; 364/464.02, 364/464.03, 464.11, 464.12, 464.18, 464.2; 177/25.15

[56] References Cited

U.S. PATENT DOCUMENTS

| | | | |
|---|---|---|---|
| 4,024,380 | 5/1977 | Gunn | 235/432 |
| 4,296,476 | 10/1981 | Mayer et al. | 395/515 |
| 4,325,440 | 4/1982 | Crowley et al. | 177/25.15 |
| 4,471,464 | 9/1984 | Mayer et al. | 395/515 |
| 4,499,545 | 2/1985 | Daniels et al. | 364/464.02 |
| 4,595,984 | 6/1986 | Daniels | 364/466 |
| 4,813,912 | 3/1989 | Chickneas et al. | 364/464.02 |
| 4,814,995 | 3/1989 | Daniels, Jr. | 364/464.02 |
| 4,858,138 | 8/1989 | Talmadge | 364/464.02 |
| 4,872,119 | 10/1989 | Kajimoto | 364/464.03 |
| 4,903,139 | 2/1990 | Minter | 358/296 |
| 5,051,925 | 9/1991 | Kadono et al. | 395/110 |
| 5,142,614 | 8/1992 | Schneider et al. | 395/115 |
| 5,150,456 | 9/1992 | Wu et al. | 395/114 |
| 5,200,903 | 4/1993 | Gilham | 364/464.02 |
| 5,319,562 | 6/1994 | Whitehouse | 364/464.02 |
| 5,357,604 | 10/1994 | San et al. | 395/162 |
| 5,388,841 | 2/1995 | San et al. | 273/435 |
| 5,410,641 | 4/1995 | Wakabayashi et al. | 395/112 |
| 5,600,562 | 2/1997 | Guenther | 364/464.11 |
| 5,602,743 | 2/1997 | Freytag | 364/464.18 |
| 5,602,921 | 2/1997 | Ramadei | 380/51 |
| 5,617,519 | 4/1997 | Herbert | 395/117 |

FOREIGN PATENT DOCUMENTS 0 285 390 B1 6/1994 European Pat. Off. .

*Primary Examiner*—Edward R. Cosimano
*Attorney, Agent, or Firm*—Ronald Reichman; Donald Walker; Melvin J. Scolnick

[57] ABSTRACT

A postage metering system comprising: structure for storing first postal information including a fixed portion of a postage indicia, the postage indicia including a variable portion thereof; structure for storing second postal information including a plurality of portions thereof respectively corresponding to a different one of a plurality of postal processing services for a sheet; structure for selectively providing at least one of the plurality of, postal processing services for the sheet; and structure for digitally printing on the sheet the first postal information and the variable portion of the postage indicia and each portion of the second postal information which corresponds to a different selected postal processing service.

18 Claims, 5 Drawing Sheets

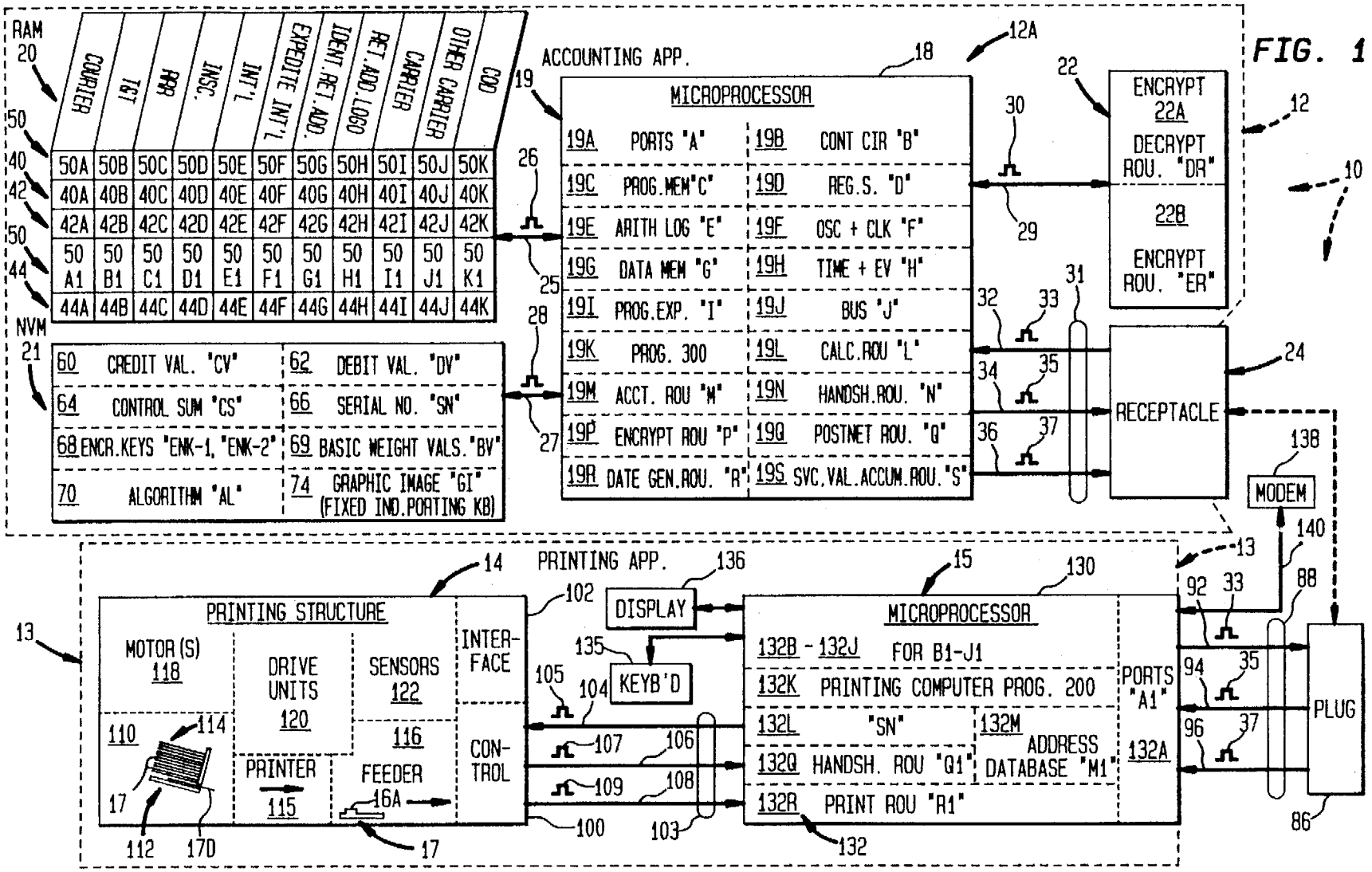
FIG. 1
ENCRYPT 22A
DECRYPT ROU. "DR"
22B
ENCRYPT ROU. "ER"
RECEPTACLE
MODEM
PLUG
ACCOUNTING APP.
MICROPROCESSOR
19A PORTS "A"
19B CONT CTR "B"
19C PROG.MEM "C"
19D REG.S. "D"
19E ARITH LOG "E"
19F OSC + CLK "F"
19G DATA MEM "G"
19H TIME + EV "H"
19I PROG.EXP. "I"
19J BUS "J"
19K PROG. 300
19L CALC.ROU "L"
19M ACCT. ROU "M"
19N HANDSH.ROU. "N"
19P ENCRYPT ROU "P"
19Q POSTNET ROU. "Q"
19R DATE GEN.ROU. "R"
19S SVC.VAL.ACCUM.ROU. "S"
PRINTING APP.
MICROPROCESSOR
132B - 132J FOR B1-J1
132K PRINTING COMPUTER PROG. 200
132L "SN"
132M ADDRESS DATABASE "M1"
132Q HANDSH. ROU "Q1"
132R PRINT ROU "R1"
PORTS "A1"
132A
DISPLAY
KEYB'D
INTER-FACE
CON-TROL
PRINTING STRUCTURE
SENSORS 122
116
FEEDER
16A
DRIVE UNITS 120
PRINTER 115
MOTOR(S) 118
110
114
112
170
RAM 20
COD
OTHER CARRIER
CARRIER
RET.ADD.LOGO
IDENT.RET.ADD.
EXPEDITE INT'L
INT'L
INSC.
RAR
T&T
COURIER
NVM 21
60 CREDIT VAL. "CV"
62 DEBIT VAL. "DV"
64 CONTROL SUM "CS"
66 SERIAL NO. "SN"
68 ENCR.KEYS "ENK-1, "ENK-2"
69 BASIC WEIGHT VALS. "BV"
70 ALGORITHM "AL"
74 GRAPHIC IMAGE "GI" (FIXED IND.PORTING KB)

POSTAGE METERING SYSTEM INCLUDING MEANS FOR SELECTING POSTAL PROCESSING SERVICES FOR A SHEET AND DIGITALLY PRINTING THEREON POSTAL INFORMATION PERTAINING TO EACH SELECTED POSTAL PROCESSING SERVICE

BACKGROUND OF THE INVENTION

This invention is generally concerned with a postage metering system including means for providing selected postal processing services for a sheet, and more particularly with means for digitally printing postal information pertaining to the selected postal processing services on the sheet.

In the course of conducting a search concerning the subject matter of the present invention, the following references were found: U.S. Pat. No. 4,296,476 for a Data Processing System With Programmable Graphics Generator, issued Oct. 20, 1981 to Mayer et al.; U.S. Pat. No. 4,471,464 for a Data Processing System With Programmable Graphics Generator, issued Sep. 11, 1984 to Mayer et al.; U.S. Pat. No. 4,903,139 for an Image Generating System For Duplex Printing, issued Feb. 20, 1990 to Minter; U.S. Pat. No. 5,051,925 for a Printer For Converting Character Codes Into Bit Images, issued Sep. 24, 1991 to Kadono et al.; U.S. Pat. No. 5,142,614 for an Expander Cartridge For Printer Font Cartridge, issued Aug. 25, 1992 to Schneider et al.; U.S. Pat. No. 5,150,456 for a Graphic Image Printing System and Method, issued Sep. 22. 1992 to Wu et al.; U.S. Pat. No. 5,319,562 for a System And Method For Purchase And Application Of Postage Using Personal Computer, issued Jun. 7, 1994 to Whitehouse; U.S. Pat. No. 5,357,604 for a Graphics Processor With Enhanced Memory Control Circuitry For Use In A Video Game System Or The Like, issued Oct. 18, 1994 to San et al.; U.S. Pat. No. 5,388,841 for an External Memory System Having Programmable Graphics Processor For Use In A Video Game System Or The Like, issued Feb. 14, 1995 to San et al.; U.S. Pat. No. 5,410,641 For an Intelligent Cartridge For Attachment To A Printer To Perform Image Processing Tasks In A Combination Image Processing System And Method Of Image Processing, issued Apr. 25, 1995 to Wakabayashi et al.; and European Patent Application Publication No. 0 285 390 A2 for a Franking Machine, applied for on Apr. 3, 1987 by Alcatel Business Systems Limited (hereinafter called Alcatel), based on an invention of Cyrus Abumehdi, and published Oct. 5, 1988 in Bulletin No. 88/40.

Of the foregoing references, the '562 Patent to Whitehouse is of specific interest in that it describes a postage metering system including an end user computer which is connectable via a modem to a postal authority computer, wherein the end user computer includes a non-volatile memory for storing postage use and other postage information, a printer, a printing program in combination with an envelope management program for directing the printer to print addresses, Postnet Bar Codes, Facing Identification Marks, known as FIM Marks, and postage on envelopes and labels, and a postage meter control program for communicating with the postal authority computer to purchase therefrom postage and to update the contents of the non-volatile memory. On the other hand, although the remaining Patent references do not discuss postage metering systems they are of general interest in that they discuss the provision of various types of memory structures, including RAM, ROM and NVM structures, for storing graphic images to be displayed, for example in a video game environment, or printed, for example by an electrophotographic printer. Moreover, the '390 A2 European Patent Application Publication of Alcatel is of specific interest in that it discusses the provision of a franking machine including means for carrying out franking and control functions, a keyboard for providing instructions to the franking machine and a printing device for franking mail items with a selected value of franking under the control of the accounting and control means, wherein the franking and control means includes a data port and a connector therefor to which a device, such as a scale, is selectively connectable, and wherein the franking machine includes means operable to control the accounting and control means to transmit to the device and receive therefrom selectively secure and non-secure data via the connector.

On the other hand the references are silent concerning the provision of a postage metering system which includes means for selecting one or more of a plurality of postal processing services for a sheet, which are beneficial to mailers and to some extent selectively offered to mailers by postal authorities, and which includes means for digitally printing selected portions of postal information on the sheet which correspond to each selected postal processing service.

Accordingly:

an object of the invention is to provide a postage metering system, including, means for selectively providing at least one of a plurality of postal processing services for a sheet, and means for digitally printing postal information on the sheet which corresponds to each selected postal processing service.

SUMMARY OF THE INVENTION

A postage metering system comprising: means for storing first postal information including a fixed portion of a postage indicia, the postage indicia including a variable portion thereof; means for storing second postal information including a plurality of portions thereof respectively corresponding to a different one of a plurality of postal processing services for a sheet; means for selectively providing at least one of the plurality of postal processing services for the sheet; and means for digitally printing on the sheet the first postal information and the variable portion of the postage indicia and each portion of the second postal information which corresponds to a different selected postal processing service.

BRIEF DESCRIPTION OF THE DRAWINGS

As shown in the drawings, wherein like reference numerals designate like or corresponding parts throughout the several views:

FIG. 1 is a schematic view of the postage metering system according to the invention, including separate printing and accounting apparatus;

DESCRIPTION OF THE PREFERRED EMBODIMENTS

Figure 2:
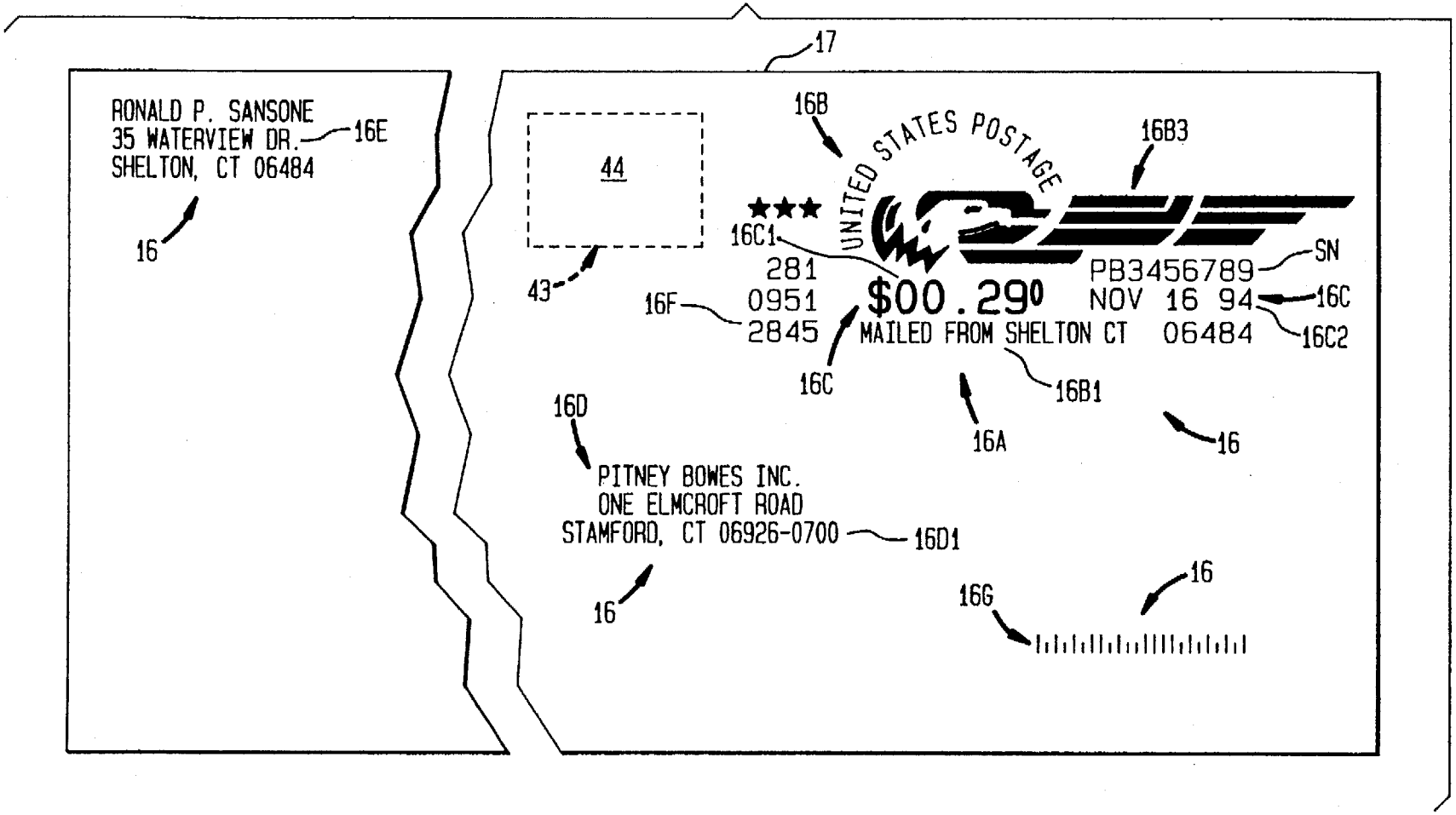
FIG. 2 is an elevation of a sheet having a preferred embodiment of a postage indicia and selected postal information printed thereon.

As shown in FIG. 1, a postage metering system 10 according to the invention generally comprises postage value accounting apparatus 12 and printing apparatus 13, which are physically separated from each other.

The printing apparatus 13 (FIG. 1), which may be either secure or non-secure, generally includes printing structure 14, and a printing computer 15 therefor for controlling the printing of alphanumeric and graphic information 16 (FIG. 2 or 3) on a sheet 17, such as a letter, card or envelope or the like, or such as a label or the like which is suitable for affixation to an article, to be mailed or shipped. The information 16 (FIG. 2 or 3) generally includes a postage indicia 16A having fixed and variable portions, 16B and 16C respectively, a variable mailing address 16D, return address 16E, verifiable encryption code 16F and conventional Postnet bar code 16G. The printing apparatus 13 (FIG. 1) is conventionally adapted to be connected in communication with the accounting apparatus 12 for sequentially obtaining therefrom respective postage indicia 16A (FIG. 2 or 3) for sequentially printing on respective sheets 17, which, according to the invention, may either be those of an indeterminate plurality of mixed letters, destined to be mailed on the same day, or those of a predetermined plurality of like sized letters known in the art as a "batch" of sheets 17, or labels for affixation to like sized articles, destined to be mailed at the same time.

Figure 3:
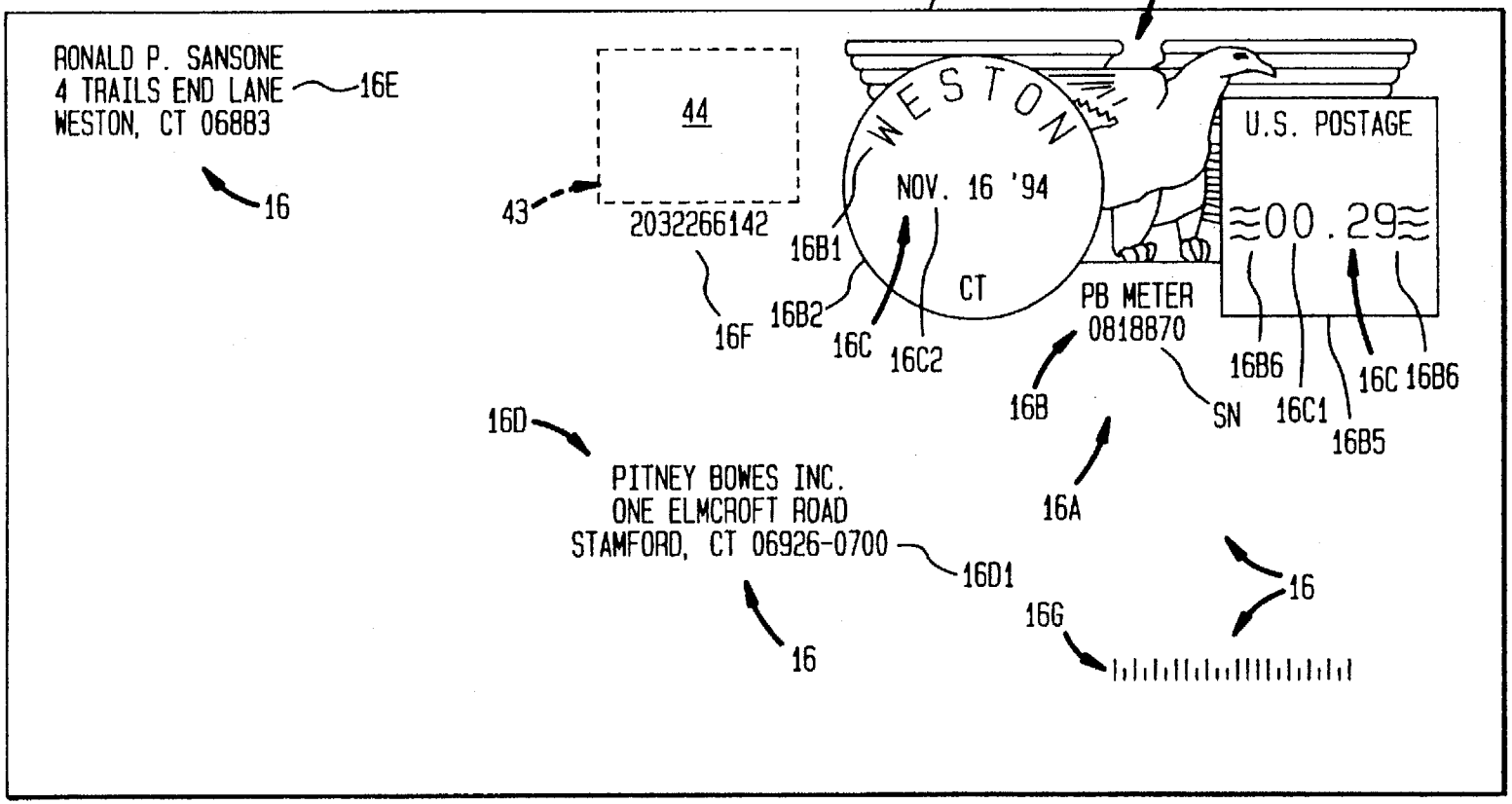
FIG. 3 is an elevation of the sheet of FIG. 2 having another embodiment of postage indicia and selected postal information printed thereon.

As shown in FIG. 2 or 3, the postage indicia's variable portion 16C includes the postage value "00.29" 16C1 and the date "Nov. 16 94" 16C2 of printing the postage indicia on the sheet 17. The postage indicia's fixed portion 16B includes information which identifies the geographic location 16B1 of the postage accounting structure 12 (FIG. 1), as exemplified in the preferred embodiment of the postage indicia 17, shown in FIG. 2, wherein the location 16B1 is printed in plain text as "SHELTON CT" in combination the Zip Code "06484" thereof, or shown in FIG. 3, wherein the location 16B1 is printed in plain text as "WESTON CT" in lieu of the corresponding Zip Code (not shown). Moreover, as shown in the postage indicia embodiment of FIG. 3, the postage indicia's fixed portion 16B preferably includes a town circle 16B2 within which the geographic location 16B1 is printed.

As shown in the postage indicia embodiment of FIG. 2, the postage indicia's fixed portion 16B also includes a pictorial representation 16B3, of an eagle in combination with three stars and the notation "UNITED STATES POSTAGE", as recently adopted by the United States Postal Service, and includes the notation "PB3456789" identifying the manufacturer, that is, "PB" for Pitney Bowes Inc., and the manufacturer's serial number, that is, "3456789", of the postage value accounting structure of the postage metering system 10. On the other hand, as shown in the embodiment of FIG. 3, the postage indicia's fixed portion 16B, optionally includes a pictorial representation 16B3, of an eagle which is a trademark of Pitney Bowes Inc., in combination with the notation "PB METER 081887" identifying, as above, the manufacturer and manufacturer's serial number of the postage value accounting structure of the postage metering system 10. Moreover, as shown in FIG. 3, the postage indicia's fixed portion 16B may also include a postage value box 16B5, in combination With the notation "U.S.POSTAGE", within the box 16B5, together with three wavy lines 16B6, known in the art as "wings", on opposite sides of the postage value "00.29" 16C1.

The postage value accounting apparatus 12 (FIG. 1) generally comprises a conventional controller or other accounting computer structure 12A including a suitable microprocessor 18. The microprocessor 18 includes conventional structure 19, having a portion 19A thereof for providing a sufficient number of communications ports "A", including interrupts, which are either already available or are programmable for serial, parallel or asynchronous communications, as the case may be, to provide a separate communications link from each of the internal components of the accounting apparatus 12 to respective external devices, such as the printing apparatus 13. Moreover, the microprocessor structure 19 includes a portion 19B thereof for providing a plurality of control circuits "B", a portion 19C thereof for providing program memory circuits "C", a portion 19D thereof for providing a plurality of working and spare register circuits "D", a portion 19E thereof for providing an arithmetic logic unit "E", a portion 19F thereof for providing circuits for one or more oscillators and clocks "F", a portion 19G thereof for providing data memory circuits "G", a portion 19H thereof for providing a plurality of timers and event counters "H", a portion 19I thereof for providing a program expansion control circuit "I", and a portion 19J thereof for providing an internal communications bus "J". Without departing from the spirit and scope of the invention, the primary computer structure may comprise a plurality of microprocessors 18 for providing added capacities which may be called for in the course of implementation of the invention.

According to the invention, the microprocessor structure 19 (FIG. 1) also preferably includes a portion 19K thereof for storing a postage value accounting application program 300 for causing the microprocessor 18 to control the various operations of the accounting apparatus 12. The microprocessor structure 19 additionally includes a portion 19L thereof for storing a postage value calculating routine "L" for calculating the total postage value 16C1 to be printed on a sheet 17, including a basic value for delivery of the sheet 17, based upon the weight of the sheet 17 or upon the weight of the article to which the sheet 17 is affixed, and including at least one service value, based Upon the selection of a corresponding one of a plurality of selectable postal processing services hereinafter discussed for the sheet 17. The microprocessor structure 19 also includes structure 19M for storing therein a postage value accounting routine "M" for accounting for respective total postage values 16C1 to be printed prior to printing thereof. Further, the microprocessor structure 19 preferably includes a portion 19N thereof for storing a conventional handshake routine "N" which utilizes the serial number "SN" of the postage value accounting apparatus 12 for connection thereof in communication with an authorized printing apparatus 13. Moreover, the microprocessor structure 19 may include a portion 19P thereof for storing an encryption routine "P" for generating respective encryption code 16F and a portion 19Q thereof for generating respective Postnet bar codes, for printing on respective sheets 17. And, the microprocessor structure 19 also preferably includes a portion 19R thereof for storing routine "R" for timely sequentially generating and storing each successive current date.

According to the invention, the postage value accounting computer 12A (FIG. 1) also preferably includes a suitable random access memory (RAM) 20, a suitable non-volatile memory (NVM) 21, and encryption and interface structures, respectively designated 22 and 24, which are conventionally connected to the microprocessor 18 and operable under the control of the accounting computer program 300.

The random access memory (RAM) 20 (FIG. 1) is suitably electrically connected to the microprocessor 18 by means of a conventional communications link 25, extending from the microprocessor bus "J", for transmitting and receiving data signals, such as the signal 26, and synchronizing communications between the microprocessor 18 and RAM 20. The non-volatile memory (NVM) is suitably electrically connected to the microprocessor 18 by means of a conventional communications link 27, extending from the microprocessor bus "J", for transmitting and receiving data signals, such as the signal 28, and synchronizing communications between the microprocessor 18 and NVM 21. The encryption structure 22 is suitably electrically connected to the microprocessor 18 by means of a conventional communications link 29, extending from the microprocessor bus "J", for transmitting and receiving data signals, such as the signal 30, and synchronizing communications between the microprocessor 18 and encryption structure 22. And, the interface structure 24, which is preferably a suitable receptacle, is suitably electrically connected to the microprocessor 18 by means of a serial, parallel or asynchronous communications link, represented by the serial communications link 31. The link 31 includes a data input lead 32, for receiving data signals, such the signal 33, from the printing apparatus 13, a data output lead 34, for providing data signals, such as the signal 35, to the printing apparatus 13, and a clock lead 36, for providing clock signals, such as the signal 37, to the printing apparatus 13 for synchronizing communications therebetween.

According to the invention, the random access memory (RAM) 20 (FIG. 1) may be any commercially available random access memory having sufficient structural capacity for storing alphanumeric and graphic information for display and selection purposes. The alphanumeric and graphic information stored for display and selection purposes preferably corresponds to a plurality of selectable postal processing services 40 for a sheet 17, including the services 40A–40K as hereinafter discussed, each of which includes a different one of a plurality of predetermined service values 42 assigned thereto, including the values 42A–42K, one or more of which may be a zero value. In addition, the RAM 20 should have sufficient capacity for storing alphanumeric and graphic information for selectively digitally printing in one or more predetermined areas on the sheet 17, represented by the preferred area 43 of FIG. 2 or 3, OCR scanable, bit-mapped, postal information 44, including a plurality of portions 44A–44K thereof, respectively corresponding to each of the selected postal processing services 40A–40K.

To that end, the random access memory (RAM) 20 (FIG. 1) comprises structure 50, including a structural portion 50A thereof for storing information for displaying the selectable postal processing service 40A of indicating that a courier is to be provided for delivery of the sheet 17, and for displaying a predetermined service value 42A therefor, and includes a portion 50A1 thereof for storing a postal information portion 44A for digitally printing an image, such as a pictorial representation of a courier carrying a letter or such as an image of a postage stamp, which corresponds to the postal processing service 40A.

In addition, the random access memory (RAM) 20 (FIG. 1) includes a structural portion 50B thereof for storing information for displaying the selectable postal processing service 40B of tracing and tracking the sheet 17, and for displaying a predetermined service value 42B therefor, and includes a portion 50B1 thereof for storing a postal information portion 44B for digitally printing notation, such as the notation "T&T", which corresponds to the postal processing service 40B.

Further, the random access memory (RAM) 20 (FIG. 1) includes a structural portion 50C thereof for storing information for displaying the selectable postal processing service 40C of requiring that a return receipt be requested for delivery of the sheet 17, and for displaying a predetermined service value 42C therefor, and includes a portion 50C1 thereof for storing a postal information portion 44C for digitally printing notation, such as the notation "RRR", which corresponds to the postal processing service 40C.

Moreover, the random access memory (RAM) 20 (FIG. 1) includes a structural portion 50D thereof for storing information for displaying the selectable postal processing service 40D of indicating that insurance has been purchased for indemnification against the loss of delivery of the contents of the sheet 17 or article to which the sheet 17 is attached, and for displaying a predetermined service value 42D therefor, and includes a portion 50D1 thereof for storing a postal information portion 44D for digitally printing notation, such as the notation "Insured", which corresponds to the postal processing service 40D.

Still further, the random access memory (RAM) 20 (FIG. 1) includes a structural portion 50E thereof for storing information for displaying the selectable postal processing service 40E of calling for international routing of the sheet 17, and for displaying a predetermined service value 42E therefor, and includes a portion 50E1 thereof for storing a postal information portion 44E for digitally printing an image, such as a pictorial representation of a globe, which corresponds to the postal processing service 40E.

In addition, the random access memory (RAM) 20 (FIG. 1) includes a structural portion 50F thereof for storing information for displaying the selectable postal processing service 40F of calling for expedited international routing of the sheet 17, and for displaying a predetermined service value 42F therefor, and includes a portion 50F1 thereof for storing a postal information portion 44F for digitally printing an image, such as a pictorial representation of a globe and an airplane, which corresponds to the postal processing service 40F.

Moreover, the random access memory (RAM) 20 (FIG. 1) includes a structural portion 50G thereof for storing information for displaying the selectable postal processing service 40G of identifying a return address for the sheet 17, and for displaying a predetermined service value 42G therefor, and includes a portion 50G1 thereof for storing a postal information portion 44G for digitally printing notation, such as the return address of the sheet, which corresponds to the postal processing service 40G.

Further, the random access memory (RAM) 20 (FIG. 1) includes a structural portion 50H thereof for storing information for displaying the selectable postal processing service 40H of providing a return address logo for the sheet 17, and for displaying a predetermined service value 42H therefor, and includes a portion 50H1 thereof for storing a postal information portion 44H for digitally printing an image, such as a pictorial representation of the return addressee's trademark or other personally selected logotype, which corresponds to the postal processing service 40H.

Still further, the random access memory (RAM) 20 (FIG. 1) includes a structural portion 50I thereof for storing information for displaying the selectable postal processing service 40I of identifying a carrier for the sheet 17, and for displaying a predetermined service value 42I therefor, and includes a portion 50I1 thereof for storing a postal information portion 44I for digitally printing an image, such as a service mark or other personally selected logotype of a non-governmental carrier, which corresponds to the postal processing service 40I.

Without departing from the spirit and scope of the invention, one or more additional carriers may be designated for delivery of a given sheet 17 (FIG. 1). Accordingly, the random access memory (RAM) 20 may include a structural portion 50J thereof for storing information for displaying the selectable postal processing service 40J of identifying at least one additional carrier for the sheet 17, and for displaying a predetermined service value 42J therefor, and includes a portion 50J1 thereof for storing a postal information portion 44J for digitally printing at least one additional image, such as at least one additional service mark or other personally selected logotype of a non-governmental carrier, which corresponds to the postal processing service 40J.

And, the random access memory (RAM) 20 (FIG. 1) may includes a structural portion 50K thereof for storing information for displaying the selectable postal processing service 40K of requiring the collection of a predetermined payment for delivery of the sheet 17, and for displaying a predetermined service value 42K therefor, and includes a portion 50K1 thereof for storing a postal information portion 44K for printing, such as the notation "COD", which corresponds to the postal processing service 40K.

According to the invention, The non-volatile memory NVM 21 (FIG. 1) may be any commercially available non-volatile memory of the type which is suitable for use for storing various values which are critical to the operation of the postage metering system 10. Depending on the country in which the postage value accounting apparatus 12 is situated, the NVM 21 may include conventional structure 60, known in the art as a descending register, for storing data corresponding to a current total postage credit value "CV", which is the total postage value currently available for printing, or, conventional structure 62, known in the art as an ascending register, for storing data corresponding to a current total debit value "DV", which is the total of all postage value increments which have been authorized to be printed by the accounting structure 12, or, preferably, both structures 60 and 62. Further, the NVM 21 preferably includes structure 64 for storing a control sum "CS", which is the sum of the aforesaid credit and debit values, "CV" and "DV", and structure 66 for storing a serial number "SN" of the postage value accounting apparatus 12. In addition, the NVM 21 preferably includes structure 68 for storing a plurality of sequentially available first encryption keys "ENK-1", and, as hereinafter discussed, for optionally storing one or more second encryption keys "ENK-2".

Moreover, the NVM 21 preferably includes structure 69 for storing a plurality conventional predetermined, selectable, basic postage values for printing on the sheet 17. Each of the basic values corresponds to a range of weights of the sheet 17, or of an article to which the sheet 17 is attached, for delivery thereof, as exemplified by the postage value "00.29" 16B1 for delivery of a sheet weighing up to one ounce. And, the NVM 21 includes structure 70 for storing an algorithm "AL" for causing the microprocessor 18 to sequentially decrement, or reduce, the credit value "CV" stored in the descending register 60 and sequentially increment, or increase, the debit value "DV" stored in the ascending register 62, respectively, by the postage values 16C1 (FIG. 2 or 3) of the postage indicia 16 which are to be sequentially printed by the printing apparatus 13 (FIG. 1), in the course of the printing apparatus 13 sequentially processing the respective sheets 17. Further, the NVM 21 preferably includes structure 74 for storing data corresponding to the fixed, graphic image "GI", portion 16B (FIG. 2 or 3) of a postage indicia 16A.

As hereinbefore noted, the microprocessor structure 19 (FIG. 1) includes structure 19M for storing therein a postage value accounting routine "M" for accounting for respective total postage values 16C1 to be printed. Further, the NVM 21 includes structure 69 for storing a plurality of predetermined, selectable, basic postage values for printing on a sheet 17. And, each of the selectable postal processing services 40A–40K for a sheet 17, includes a different one of a plurality of service values 42A–42K assigned thereto, including but not limited to a zero postage value. Thus, according to the invention, the microprocessor structure 19 preferably includes a portion 19S thereof for storing therein a service value accumulating routine "S", for accumulating a total service value which includes each of the service values 42A–42K assigned to the selected postal processing service 40A–40K for a given sheet 17, and for adding the accumulated total service value and basic postage value to derive the total postage value 16C1 to be printed on the given sheet 17.

Further, as hereinbefore noted, some of the postal processing services 40A–40K discussed herein are selectively offered to mailers by postal authorities. Such services include the trace and track, return-receipt-requested and insurance services 40B, 40C and 40D. When such services 40B–40D have been provided prior to the present invention, postal authorities have required mailers to fill in, by hand, a postal form for each of the trace and track, return-receipt-requested and insurance services 40B–40D purchased for each sheet 17. The present invention does not include provision for printing postal forms to accompany sheets 17 for which such services 40B–40D have been purchased. Rather, it is contemplated that when sheets 17 for which such services 40B–40D have been purchased are delivered to the postal service for mailing purposes, the appropriate postal forms will be prepared.

The encryption structure 22 (FIG. 1) is preferably conventionally operable under the control of the primary computer program 300. The encryption structure 22 includes a portion 22A thereof for storing a suitable decryption routine "DR", of the application program 300, for utilizing the next available encryption key "ENK-1" for decrypting respective codes, received from an external device such as a data center, which have embedded therein data corresponding to postage funds to be credited to the total credit value "CV". In addition, the encryption structure 22 includes a portion 22B thereof for storing therein a suitable encryption routine "ER" which utilizes the encryption key(s) "ENK-2" for encrypting data corresponding to any, some or all of the alphanumeric or graphic information, or both, which is to be printed in plain text on the sheet 17, to provide the verifiable encryption code 16F printed on the sheet 17. To that end, the encryption structure 22 (FIG. 1) is operable under the control of the microprocessor 18 for encrypting data corresponding to one or more of the numerical values stored in the NVM 21 or microprocessor 18, or both, including the current date (FIG. 2 or 3), current postage indicia's postage value 16C1, a portion of the data corresponding to each mailing address 16D, such as the zip code 16D1 thereof, and a part of the postage indicia's fixed, graphic image "GI", portion 16B. Without departing from the spirit and scope of the invention, the encryption structure 22 may be a suitable electrical circuit which is located externally of the microprocessor 18, or an encryption circuit routine "P" of the accounting computer application program 300. As noted above, the encryption code 16F is characterized as being "verifiable". In this connection it is noted that assuming the Postal Service has a computer having stored therein the encryption routine "P" and the encryption keys "ENK-2", then, the plain text alphanumeric and graphic information on the face of the envelope 17D which was encrypted by the microprocessor 18 may be read from the envelope 17 and encrypted by the Postal Service computer to produce an encryption code which may be compared to the encryption code 16F printed on the envelope 17 in order to verify that they are the same.

In the preferred embodiment, the accounting apparatus 12 (FIG. 1) is a suitable, commercially available computer disc, and the printing apparatus 13 includes suitable structure for conventionally removably connecting the disc thereto for communication therewith via a suitable communication link represented by the link 88. Alternatively, the printing apparatus 13 is conventionally removably connectable in communication with the postage value accounting apparatus 12 by means of a conventional electrical plug 86 of a suitable communications link 88 represented by the link 88 of the printing apparatus 13. In either event, the communications link 88 may include a data output lead 92, for providing data signals, such the signal 33, to the microprocessor 18, a data input lead 94, for receiving data signals, such as the signal 35, from the microprocessor 18 and a clock lead 96, for receiving clock signals, such as the signal 37, from the microprocessor 18 for synchronizing communications between the microprocessor 18 and printing system 13.

The printing structure 14 (FIG. 1) is preferably a conventional, standalone, device which includes suitable control circuit 100, such as a microprocessor, for controlling the various functions of the printing structure 14. The printing structure 14 may include a conventional operator interface 102, such as a suitable keyboard, which is conventionally coupled to the control structure 100 for providing input signals thereto in response to actuation of the keyboard. Whether or not the printing structure 14 includes an operator interface 102, the control circuit 100 is preferably conventionally adapted to include a two-way serial or parallel communications link, represented by the serial communications link 103, for conventionally coupling the control circuit 100 to an external source, such as the printing computer 15. The communications link 103 includes a data output lead 104, for providing data signals, such the signal 105, to the printing computer 15, a data input lead 106, for receiving data signals, such as the signal 107, from the printing computer 15 and a clock lead 108, for receiving clock signals, such as the signal 109, from the printing computer 15 for synchronizing communications between the printing computer 15 and printing structure 14. Thus the printing module 14 is preferably adapted to permit control of the structures and functions thereof from the printing computer 15 rather than from the operator interface 102.

The printing structure 14 (FIG. 1) additionally includes conventional sheet stacking structure 110, such as a suitable hopper 112 into which a stack 114 of sheets 17D, may be loaded. The printing structure 14 also includes conventional printing device 115, such as any conventional ink jet, laser or other commercially available digital printing device to which sheets 17 are fed from the hopper 112 for printing alphanumeric and graphic information thereon. In addition, the printing structure 14 includes conventional sheet feeding structure 116 which is suitably electrically connected to and operable under the control of the control circuit 100 for sequentially feeding sheets 17 from the stack 114. The feeding structure 116 may be any conventional vacuum or roller type structure for sequentially engaging the respective top or bottom sheet 17 in the stack 114 and feeding the respective sheets 17 from the hopper 112 to the printing device 115 and, after printing, sequentially feeding the respective sheets 17 from the printing structure 14. Further, the printing structure, 14 includes a suitable motor 118, which is connected to an operable under the control of the control circuit 100, and includes one or more drive units 120, which are respectively connected between the motor 118 and feeding structure 116. Moreover, the printing structure 14 may include a plurality of conventional sensors 122 for sensing various positions of respective sheets 17 and of selected elements of the feeding structure 116, motor 118 and drive units 120, including their respective home positions, at selected time intervals. The sensors 122 are conventionally electrically connected to the control circuit 100 for providing analog signals thereto. And the control circuit 100 is conventionally constructed arranged, for example as by programming in the case of the control circuit 100 being a microprocessor, for providing digital signals, such as the signal 105, to the printing computer 15 which correspond to the various positions of respective sheets 17D, and to the respective positions of the selected elements of the feeding structure 116, motor 118 and drive units 120, at selected time intervals.

The printing computer 15 (FIG. 1), may be any commercially available computer, such as a conventional controller or personal computer. The printing computer 15 generally comprises a microprocessor 130, which includes conventional structure 132 having respective portions 132A–132J thereof, for providing a plurality of circuits, stored data and programs, A1–J1 inclusive, which respectively correspond in all respects to the circuits, stored data and programs, A–J inclusive, of the microprocessor 18. In addition, the structure 132 includes a portion 132K thereof for storing a printing computer program 200 for controlling the printing apparatus 13. Further, the structure 132 includes a portion 132L thereof for storing the serial number "SN" of the primary accounting apparatus 12 to which the printing apparatus 12 is authorized to be connected. In addition, the structure 132 preferably includes a portion 132M thereof for storing a mailing address database "M1". Moreover, the structure 132 includes a portion 132Q thereof for storing a conventional hand shake routine "Q1" of the printing computer program 200, which utilizes the serial number "SN" of the postage accounting apparatus 12 for connecting the printing apparatus 13 in communication with the postage accounting apparatus 12 under the control of the postage accounting computer program 300. Still further, the structure 132 includes a portion 132R thereof for storing a printing routine "R1", for causing the printing computer 15 to obtain data corresponding to respective mailing addresses 86 (FIG. 2) from the mailing address database "M1" (FIG. 1), and to request the provision of data from the accounting apparatus 13, corresponding to the current postage value 16C1 (FIG. 2 or 3) and fixed portion 16B of the postage indicia 16A, and each of the plurality of postal information portions 44A–44K, corresponding to each of the selected postal processing services 40A–40K, the encryption code 16F and Postnet bar code 16G and to merge the postage indicia 16A and codes 16F and 16G with the mailing address 16D and return address 16E, for printing on the sheet 17.

Further, rather than or in addition to providing the control structure 100 (FIG. 1), the printing computer 15 preferably includes a keyboard 135 and display 136, respectively for manually entering information calling for the display of the postal processing services 40A–40K, together with the service values 42A–42K thereof concerning respective sheets 17 or batches thereof under the control of the accounting computer program 300. Moreover, the printing computer 15 preferably includes a suitable display 136, which is conventionally connected to the microprocessor 130 and operable under the control thereof for displaying input received via the control circuit 100, keyboard 135 and microprocessor's communication ports A1. In this connection, a plurality of the ports A1 are preferably conventionally programmed to serve as an I/O port for conventionally removably connecting an external device, such as a modem 138, to the printing computer 15 via a suitable communication link, represented by the link 140. As thus constructed and arranged the printing computer 15 is adapted to be electrically connected in communication with external apparatus, such as a conventional data center, for changing at least one service value.

Figure 4A:
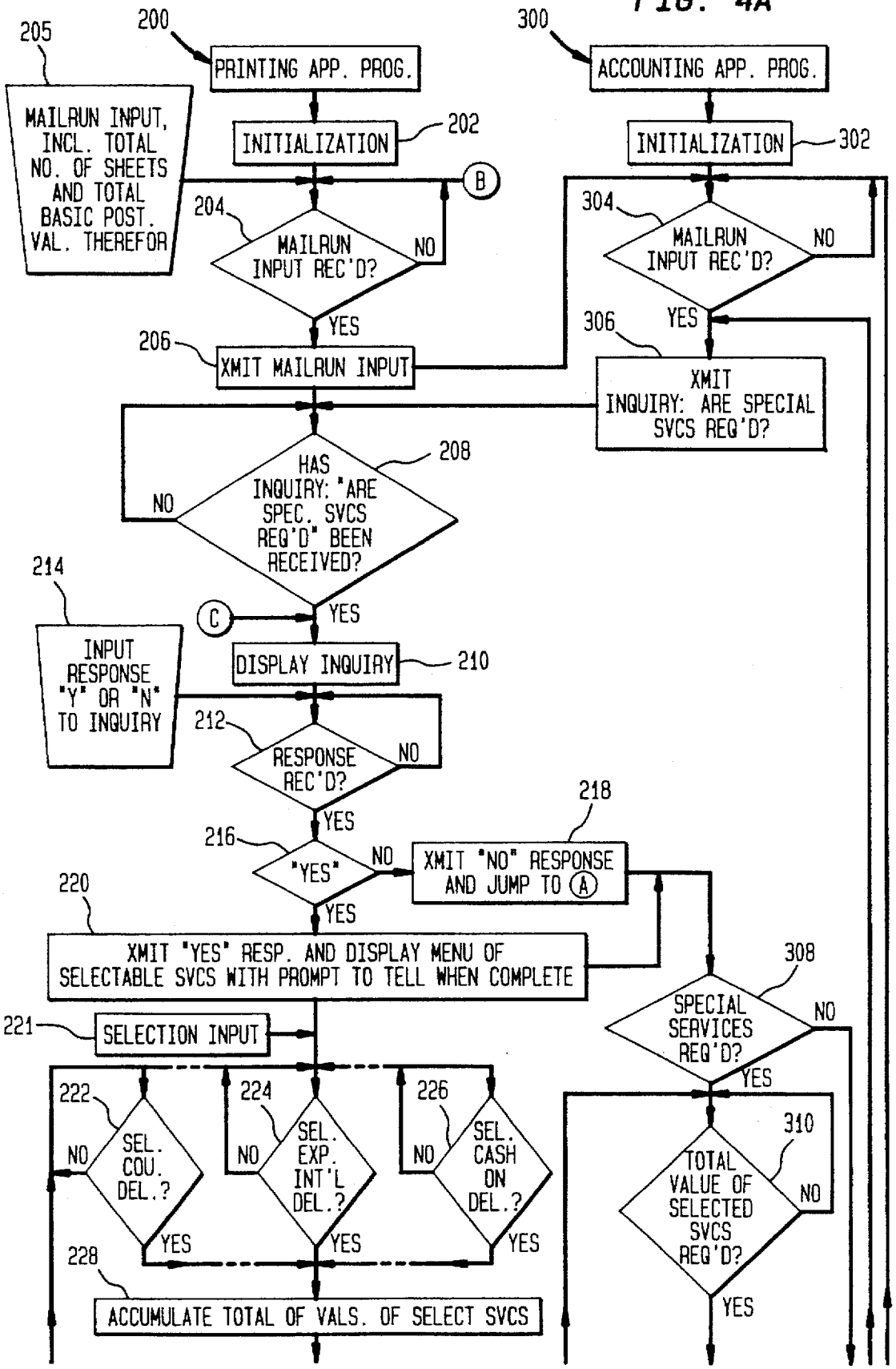
FIG. 4 is a flow chart of a process implemented by the printing and accounting apparatus, for printing postage indicia and postal information corresponding to selected postal processing services on a sheet, and for accounting for the total postage value for delivery of the sheet and the provision of the selected postal processing services therefor.
Figure 4B:
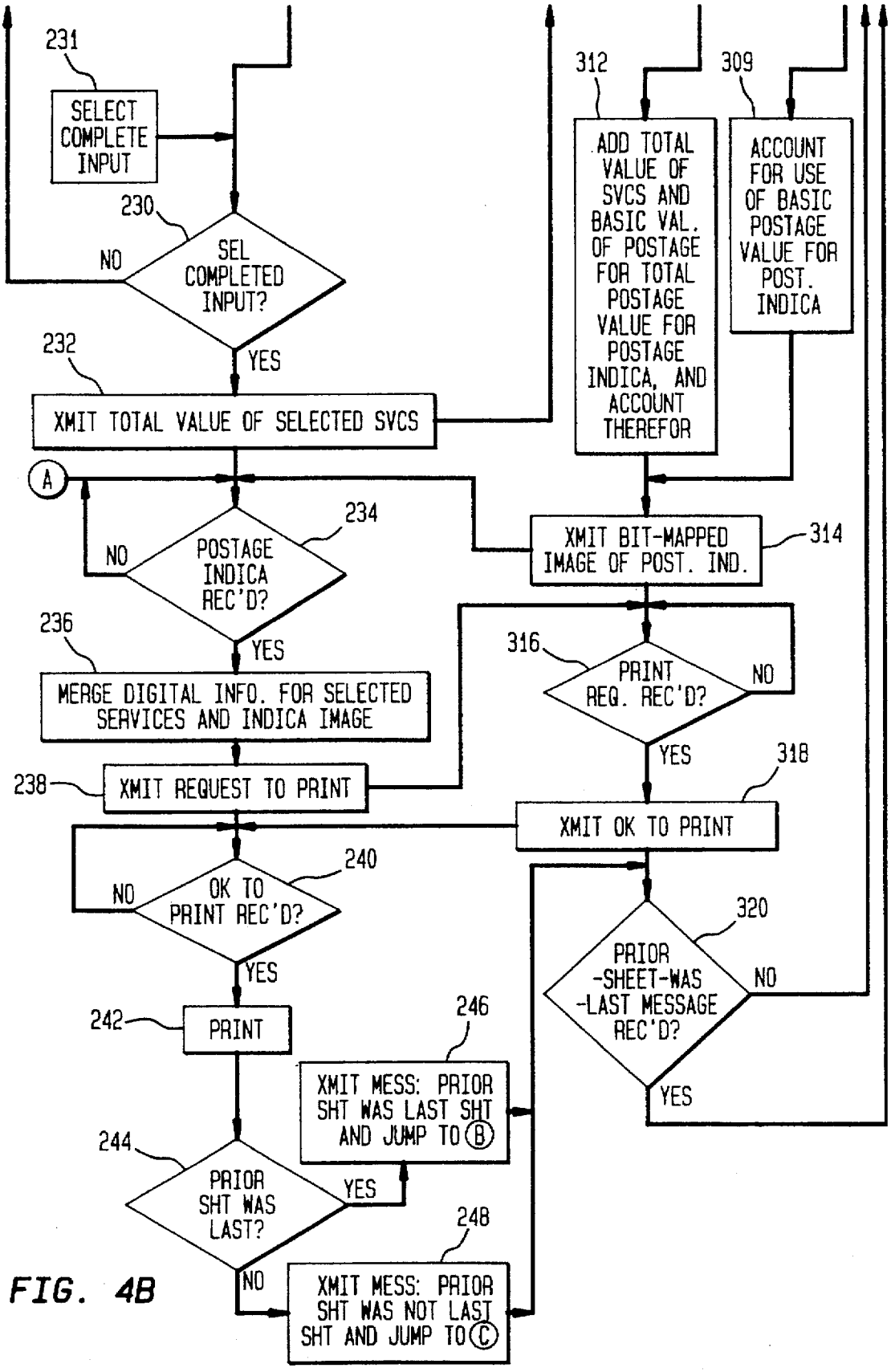

The following discussion of FIG. 4 assumes prior energization of the postage metering system 10 (FIG. 1), and thus energization of the postage value accounting apparatus 12 and printing apparatus 13. Whereupon, the printing computer 15, under the control of the printing computer program 200 (FIG. 4), implements the step 202 of initializing the microprocessor 130 (FIG. 1), and the keyboard 135 and display 136 connected thereto, followed by the step 204 (FIG. 4) of determining whether information pertaining to a mailrun has been received. And, concurrently therewith, the accounting computer 12A (FIG. 1), under the control of the accounting computer program 300 (FIG. 4) implements the step 302 thereof of initializing accounting microprocessors 18 (FIG. 1), and the RAM 20, NVM 22 and encryption structure 22 connected thereto, followed by the followed by the step 304 (FIG. 4) of determining whether information pertaining to a mailrun has been received.

With reference to FIGS. 1 and 4, assuming information pertaining to at least one sheet 17, and, more commonly a mailrun comprising a batch of sheets 17 is not received by the printing apparatus 13, the program 200 causes the microprocessor 130 to continuously loop through step 204 until the mailrun input, step 205, is received. And, concurrently therewith, the program 300 causes the microprocessor 130 to continuously loop through step 304 until the mailrun input is received. Step 205 normally entails the manual entry by the operator of the postage metering system 10, via the printing apparatus keyboard 136, of information indicating the total number of sheets 17 of a batch thereof, a selected basic postage value required for delivery of each sheet by the postal service, including the contents thereof or the article to which the sheet is to be attached, and the total of the basic postage values for the batch. Assuming the mailrun input, step 205, is received, step 205, the program 200 causes the microprocessor 130 to implement the step 206 of transmitting the mailrun input 205 to the accounting apparatus 12, followed by continuously looping through the step 208 of determining whether a message has been received from the accounting apparatus 12 which inquires whether special services are required for the first sheet 17 of the batch. On the other hand, when the accounting apparatus 13 receives the mailrun input, step 304, the program 300 causes the microprocessor 18 to implement the step 306 of transmitting the awaited for inquiry to the printing apparatus 12 concerning whether special services are required for the first sheet 17, followed by continuously looping through the step 308 of inquiring whether the printing apparatus 13 requires special services for the sheet 17.

Referring again to FIGS. 1 and 4, upon receiving the inquiry, step 208, from the accounting apparatus 12 concerning whether special services are required for the first sheet 17, the printing apparatus program 200 causes the microprocessor to drive the display 136 to display the inquiry 210, thereby visually prompting a response to the inquiry by the operator of the postage metering system 10, followed continuously looping through the step 212 of determining whether a response is received. Assuming a response 214 is received, step 212, due to the operator of the system 10 manually entering a response corresponding to "yes" or "no" into the printing apparatus 12 via the keyboard 136, then, the program 200 causes the microprocessor 130 to implement the step 216 of determining whether the response was "Yes".

For the purposes of this discussion it will be assumed, until otherwise stated, that special services are required for processing all of the respective sheets 17 of a batch. Accordingly, with further reference to FIGS. 1 and 4, assuming the response to the inquiry of step 216 is positive, the printing computer program 200 causes the microprocessor 130 to execute the step 220 of transmitting a "yes" response to the accounting apparatus 12 and driving the printing apparatus display 136 to display the menu of a list of selectable services 40, including the services 40A–40K and assigned service values 42A–42K thereof, and including a prompt calling for the operator of the system 120 to provide a selection-completed input when the selection from such services is complete. In response to receiving the "yes" response from the printing apparatus 12, indicating that special services are required for the first sheet 17, the accounting apparatus program 300 causes the microprocessor 18 to continuously loop through the step 310 of determining whether the total value of the selected services has been received. And, concurrently therewith, following step 220 the printing apparatus program 200 causes the microprocessor 130 to sequentially continuously loop: through parallel steps for each of the services 40A–40K awaiting selection input 221 coinciding with the display or a desired service, for determining whether one or more of such services 40A–40K have been selected for the sheet 17, as exemplified by the steps 222, 224 and 226 (If, no the program continues to loop and if yes the valve for that service is added in the accumulator 228) for determining whether one or more of the courier delivery, expedited international delivery and cash on delivery services 40A, 40F and 40K have been selected; thereafter through the step 228 of accumulating a total of one or more of the service values 42A–42K corresponding to the one or more selected services 40A–40K, such as the assigned values 42A, 42F and 42K of the exemplary services 40A, 40F and 40K, if selected; and thereafter through the step 230 of determining whether a "selection-completed" input has been received by the printing apparatus 13. If, select completed input is not enabled the program loops out to continuously make available the selectable services until selection complete is selected.

With still further reference to FIGS. 1 and 4, when the selection-completed input is received, step 231, for example, due to the operator of the postage metering system 10 providing the appropriate input, step 231, to the printing apparatus 13 via the keyboard 136, the printing apparatus program 200 then causes the microprocessor 130 to implement the step 232 of transmitting to the accounting apparatus 12, the accumulated total of the service values assigned the selected services, followed by the step of continuously looping through the step 234 of determining whether a bit mapped image of a postage indicia has been received. Upon receiving the accumulated total service values, and thus a positive response to the inquiry of step 310, the accounting apparatus program 300 causes the microprocessor 18 to implement the step 312 of adding the accumulated total service values and the basic postage value for mailing the first sheet 17, to derive the total postage value 16C1 to be included in the postage indicia 16A for the first sheet 17, followed by accounting for the use of funds corresponding to the total postage value 16C1. Thereafter the program 300 causes the microprocessor 18 to implement the step 314 of transmitting to the printing apparatus 12, a bit-mapped image of a postage indicia 16A including the aforesaid total postage value 16C1 and the current date 16C2, followed by continuously looping through the step 316 of determining whether a request to print has been received from the printing apparatus 12. When the printing apparatus 13 receives the bit-mapped image of the postage indicia 16A for the first sheet 17, the printing computer program 200 causes the microprocessor to implement the step 236 of effectuating a merger of the bit-mapped image of the postage indicia 16A and the respective bit-mapped image portions, of the portion 44A–44K, corresponding to the selected services, of the services 40A–40K, for digitally printing on the first sheet 17 a composite bit-mapped image of the postage indicia 16A and information 44 corresponding to the selected services.

Following step 236 (FIG. 4), the printing computer program 200 causes the microprocessor 130 to implement the step 238 of transmitting a request-to-print message to the accounting apparatus 12, followed by continuously looping through the step 240 of determining whether a permission-to-print message has been received. When the accounting apparatus 12 receives the request-to-print message, and thus a positive response to the inquiry of step 316, the accounting computer program 300 causes the microprocessor 18 to implement the step 318 of transmitting a permission-to-print message to the printing apparatus 13, followed by the step 320 of determining whether a message has been received therefrom which indicates that the prior sheet 17, which has heretofore been referred to as the first sheet 17, was the last sheet 17. Assuming the inquiry of step 320 is affirmatively answered, the program 300 returns processing to step 304, to await the next mailrun. On the other hand, assuming the inquiry of step 320 is negatively answered, then the program 300 causes the microprocessor 18 to return processing to step 300, which is followed by the step 306 of transmitting an inquiry to the printing apparatus 13 as to whether the next sheet 17 requires special services. When the printing apparatus 13 receives the permission-to-print message, the printing computer program 200 causes the microprocessor 130 to implement the step 242 of driving the printing structure 14 to digitally print on the first sheet 17 the above discussed composite bit mapped image of the postage indicia 16A and service information 44, followed by the step 244 of determining whether the prior sheet was the last sheet 17. Thereafter, assuming the prior sheet was the last sheet, the printing apparatus program 200 implements the step 246 of transmitting to the accounting apparatus 12 a message indicating that the prior sheet 17 was the last sheet 17, followed by causing processing to jump to "B" and thus to the step 204 of determining whether the next mailrun input has been received. On the other hand, assuming the prior sheet was not the last sheet, the printing apparatus program 200 implements the step 248 of transmitting to the accounting apparatus 12 a message indicating that the prior sheet 17 was not the last sheet 17 followed by causing processing to jump to "C" and thus to the step 210 of displaying the inquiry as to whether special services are required for the next sheet 17.

Referring back to step 216 (FIG. 4), wherein a determination is made as to whether the response received to the inquiry about whether special services are required is "yes", and assuming that the response is negative, then, the printing apparatus program causes the microprocessor to implement the step 218 of transmitting a "no" message to the accounting apparatus 12, indicating that special services are not required for the first sheet 17, followed by returning processing to "A", and thus to the step 234, as hereinbefore discussed, of determining whether a bit-mapped image of a postage indicia 16A has been received from the accounting apparatus 12. When the accounting apparatus 13 receives the "no" message from the printing apparatus 13, the program 300 causes the microprocessor 18 to implement the step 309 of accounting for the use of funds corresponding to the basic postage value for delivery of the sheet 17 as the postage value 16C1 which is to be used when printing the postage indicia 16A on the first sheet 17, followed by the step 314 as hereinbefore discussed of transmitting the bit-mapped image of the postage indicia 16A including the basic postage value 16C1 and current date 16C2, to the printing apparatus 13. The above specification describes a new and improved postage metering system for digitally printing postal indicia and postal information which corresponds to different selected postal services. It is realized that the above description may indicate to those skilled in the art additional ways in which the principles of this invention may be used without departing from the spirit. It is, therefore, intended that this invention be limited only by the scope of the appended claims.

What is claimed is:

1. A postage metering system comprising:

(a) means for storing first postal information including a fixed portion of a postage indicia, the postage indicia including a variable portion thereof;

(b) means for storing second postal information including a plurality of portions thereof respectively corresponding to a different one of a plurality of postal processing services for a sheet;

(c) means for selectively providing at least one of the plurality of postal processing services for the sheet; and (d) means for digitally printing a graphical image on the sheet the first postal information and the variable portion of the postage indicia and each portion of the second postal information which corresponds to different selected postal processing service.

2. The postage metering system according to claim 1, wherein the variable portion of the postage indicia includes a total postage value to be printed, each of the plurality of postal processing services having assigned thereto one of a plurality of predetermined service values, the plurality of predetermined service values including a zero value, and the total postage value to be printed including the service value of each selected postal processing service.

3. The postage metering system according to claim 1, wherein a second postal information portion includes information for indicating that a courier is to be provided for delivery of the sheet.

4. The postage metering system according to claim 1, wherein a second postal information portion includes information for tracing and tracking the sheet.

5. The postage metering system according to claim 1, wherein a second postal information portion includes information requiring that a return receipt be requested.

6. The postage metering system according to claim 1, wherein a second postal information portion includes information indicating that insurance has been purchased for delivery of the contents of the sheet.

7. The postage metering system according to claim 1, wherein a second postal information portion includes information calling for international routing of the sheet.

8. The postage metering system according to claim 1, wherein a second postal information portion includes information calling for expedited international routing of the sheet.

9. The postage metering system according to claim 1, wherein a second postal information portion includes information identifying a return address for the sheet.

10. The postage metering system according to claim 1, wherein a second postal information portion includes information providing a return address logo for the sheet.

11. The postage metering system according to claim 1, wherein a second postal information portion includes information identifying a carrier for the sheet.

12. The postage metering system according to claim 1, wherein a second postal information portion includes information requiring the collection of a predetermined payment for delivery of the sheet.

13. The postage metering system according to claim 1 including random access memory means, and the random access, memory means including the means for storing the second postal information.

14. The postage metering system according to claim 13, wherein the means for digitally printing includes printing apparatus and printing computer means, and the random access memory means is electrically connectable to the printing computer means.

15. The postage metering system according to claim 2, wherein the means for digitally printing includes printing apparatus and printing computer means for controlling the printing apparatus.

16. The postage metering system according to claim 15 including non-volatile memory means electrically connectable to the printing computer means, and the non-volatile memory means including the first postal information and thus the fixed portion of the postage indicia.

17. The postage metering system according to claim 15 including accounting means removably electrically connectable to the printing computer means, the accounting means including the non-volatile memory means, the accounting means including accounting computer means, the accounting computer means including means for calculating the total postage value to be printed, and the total postage value to be printed including a base value for delivery of the sheet.

18. The postage metering system according to claim 15, wherein the printing computer means is adapted to be electrically connected in communication with external means for changing at least one service value.

* * * * *